US005097232A

United States Patent [19]

Stopper

[11] Patent Number: 5,097,232

[45] Date of Patent: Mar. 17, 1992

[54] TRANSMISSION LINES FOR WAFER-SCALE INTEGRATION AND METHOD FOR INCREASING SIGNAL TRANSMISSION SPEEDS

[75] Inventor: Herbert Stopper, Orchard Lake, Mich.

[73] Assignee: Environmental Research Institute of Michigan, Ann Arbor, Mich.

[21] Appl. No.: 492,420

[22] Filed: Mar. 6, 1990

Related U.S. Application Data

[63] Continuation of Ser. No. 368,992, Jun. 16, 1989, abandoned, which is a continuation of Ser. No. 253,411, Oct. 4, 1988, abandoned, which is a continuation of Ser. No. 9,275, Jan. 30, 1987, abandoned.

[51] Int. Cl.[5] ..... H01P 1/15; H01P 3/08

[52] U.S. Cl. ..... 333/104; 333/238; 333/246; 333/262

[58] Field of Search ..... 333/103, 104, 238, 243, 333/245, 246, 247, 262

[56] References Cited

U.S. PATENT DOCUMENTS

| | | | |
|---|---|---|---|
| 2,934,723 | 4/1960 | Hewitt, Jr. | 333/238 X |
| 2,954,468 | 9/1960 | Matthaei | 333/238 X |
| 3,419,813 | 12/1968 | Kamnitsis | 333/238 X |
| 3,432,778 | 3/1969 | Ertel | 333/247 X |
| 3,634,789 | 1/1972 | Stuckert | 333/238 X |
| 3,675,090 | 7/1972 | Neale . | |
| 3,997,851 | 12/1976 | Sechi | 333/247 X |
| 4,210,885 | 7/1980 | Ho | 333/238 |
| 4,458,297 | 7/1984 | Stopper et al. | 361/403 |
| 4,467,400 | 8/1984 | Stopper . | |
| 4,479,088 | 10/1984 | Stopper . | |
| 4,553,050 | 11/1985 | Feinberg et al. . | |
| 4,626,889 | 12/1986 | Yamamoto et al. | 333/246 X |
| 4,866,507 | 9/1989 | Jacobs et al. | 357/74 |

OTHER PUBLICATIONS

*Handbook of Tri-Plate Microwave Components*, Sanders Assoc., Nashue, N.H. 1956, pp. 20,25,54,title page, TK7870S3.

"Triplate Structure Design for Thin Film, Lossy, Unterminated Transmission Lines", A. Deutsch and C. W. Ho, 1981, IEEE.

"The Thin-Film Module as a High-Performance Semiconductor Package" by C. W. Ho, et al., IBM J. res. Develop. vol. 26, No. 3, May, 1982.

"The Wafter Transmission Module" Capt. B. J. Donlan, et al., VLSI Systems Design, Jan. 1986.

*Primary Examiner*—Paul Gensler

*Attorney, Agent, or Firm*—Krass & Young

[57] ABSTRACT

A method and apparatus for optimizing the signal transmission speed between a signal source and a signal receiver of a microelectronic circuit is disclosed. The method includes the step of providing a signal transmission path whose length provides a predetermined ratio between its resistance and characteristic impedance which will reproduce the transmitted signal at the receiving end upon the first signal transition. The length of this transmission path may be increased by using a nonhomogeneous line structure in which the characteristic impedance increases in the direction of the signal transmission. In one form of the invention, the signal transmission path is formed by interconnecting a plurality of micro-strip conductors disposed on different planes of a universally programmable silicon circuit board. Under the appropriate circumstances, a signal can travel through such a "semi-lossy" transmission path at approximately the speed of light.

11 Claims, 7 Drawing Sheets

TRANSMISSION LINES FOR WAFER-SCALE INTEGRATION AND METHOD FOR INCREASING SIGNAL TRANSMISSION SPEEDS

This is a continuation of U.S. Pat. application Ser. No. 368,992, filed June 16, 1989, now abandoned, which is a continuation of Ser. No. 253,411, filed Oct. 4, 1988, now abandoned, which is a continuation of Ser. No. 009,275, filed Jan. 30, 1987, now abandoned.

BACKGROUND OF THE INVENTION

The present invention relates generally to signal transmission lines built on silicon wafers for the purpose of wafer-scale integration, and more particularly to micro-strip signal transmission lines for programmable interconnection wafers which are constructed to optimize signal transmission speeds.

In the past, integrated circuit (IC) chips were electrically connected together through the use of "pin" packages and printed circuit boards. Each IC chip would first be mounted in the cavity of a separate pin package which had to be large enough to provide a number of sturdy pin connections. Then, these IC chips containing packages would be mounted to a printed circuit board which was designed to provide a specific pattern of electrically conductive paths necessary to interconnect the pins of these packages together in the desired way.

While this technique of interconnecting IC chips together has been used for many years, it has several drawbacks. In the first place, it takes up far too much room. Since the IC chips themselves occupy only a very small amount of a typical pin package, and the pin packages must be separated on the circuit board, a great deal of wasted space is built in to each multi-chip circuit design. While the amount of this wasted space can be reduced by integrating more transistors into each IC chip, eventually the designer will be faced with the need to interconnect various IC chips together in order to achieve a unique circuit design. Accordingly, achieving higher densities within each chip only addresses one aspect of the wasted space problem. The interconnection between discrete IC chips must still be addressed in order to provide a truly dense circuit design.

It will also be appreciated that substantial costs are associated with this type of low density interconnection technique. Each circuit board has to be individually designed to provide a printed pattern of conductive paths which is appropriate to the size, type and number of IC chips contained on the circuit board card. Additionally, a separate pin package must be provided for each IC chip manufactured, and these pin packages may also have to be designed specifically for its intended IC chip.

Perhaps the most important consideration involved in interconnecting IC chips together in one of time. Since the conductive paths through the pin packages and the circuit board are relatively long, the operation of the IC chips is constrained by the time it takes for signals to be transmitted between the IC chips. Accordingly, if the length of these conductive paths can be reduced, then the transmission delays can also be reduced as well. This consideration is particularly important in the field of super computers where processing speed and heat dissipation are paramount considerations.

In order to decrease the distance between IC chips, "thick film" ceramic circuit boards have been proposed. While such circuit boards permit the mounting of IC chips directly to the ceramic substrate of these boards, the layout of conductive paths for these circuit boards still need to be individually designed for each application. Additionally, the density of the number of IC chips per circuit board area is limited by the nature of the pattern of conductive paths which is typically formed on a single layer of the ceramic substrate.

A further advance toward the goal of providing dense interconnections between IC chips has recently been realized through the use of a universally programmable silicon circuit board (SCB). An SCB is a standardized, electrically programmable interconnect system which is formed on a silicon wafer or substrate. An SCB can be characterized as "thin film" circuit board technology, due to the fact that the conductive paths have dimensions in the micron region. The SCB permits a product designer to mount diverse IC chips and hybrid components directly to a very compact silicon substrate which acts as a circuit board. No pin packages are required, and the SCB can be programmed electronically so that a single SCB design can serve a wide variety of multi-chip circuit designs.

Each SCB includes a matrix of orthogonal metal lines which are disposed on distinct planes. These planes are separated at crossovers by an amorphous silicon material which normally has a high resistance. However, this layer of amorphous silicon is designed to operate as an "anti-fuse" in that selected electrical connections can be made between the metal lines on different planes. Specifically, when a threshold voltage is applied to the amorphous silicon, the material will switch from a high resistance value to a low resistance value at a desired interconnection point. This "anti-fuse" capability of the amorphous silicon allows many thousands of possible interconnections to be made between various metal lines of the SCB matrix, and hence a host of different IC chip interconnections can be readily made using automated programming techniques.

In addition to the above, other advantageous features of the SCB include the ability to mount the IC chips to the substrate through conventional wire bonding techniques, and temperature matching of silicon IC chips with the silicon substrate to reduce stress and fatigue. The integrity of the interconnection network can also be automatically tested, and faults can be readily corrected by programming alternate routes through the network. The electrical programming of the network by firing the appropriate "anti-fuses" can be accomplished within hours, so that a design engineer does not have to wait long periods of time for masks to be developed and the line.

A further general discussion of SCBs may be found in the following references: U.S. Pat. No. 4,467,400, issued on Aug. 21, 1984 to Herbert Stopper, entitled "Wafer Scale Integrated Circuit"; U.S. Pat. No. 4,479,088, issued on Oct. 23, 1984 to Herbert Stopper, entitled "Wafer Including Test Lead Connected To Ground For Testing Networks Thereon"; U.S. Pat. No. 4,458,297, issued on July 3, 1984 to Herbert Stopper et. al., entitled "Universal Interconnection Substrate"; and an article entitled "A Wafer With Electrically Programmable Interconnections", 1985 IEEE International Solid-State Circuits Conference, Digest of Technical Papers, pp. 268–269. These references and hereby incorporated by reference.

As will be discussed further below, the metal lines of the SCB may approach the "lossy line" transmission characteristics of a Thomson Cable. This lossy line characteristic has the advantage of eliminating the need for terminating resistors. However, this characteristic can also result in undesirable transmission delays through the interconnection network. Specifically, for homogeneous metal lines in an SCB network, this delay has been found to be proportional to the square of the length. Accordingly, it should be appreciated that the length of the SCB signal transmission lines can become an important design consideration when extremely high processing speeds are desired. Thus, on one hand, long signal transmission lines can facilitate the interconnection of many IC chips on a single SCB. However, on the other hand, it is possible that such long signal transmission lines may not be consistent with achieving the goal of maximizing the overall processing speed for multichip circuits and other micro-electronic circuits.

Accordingly, it is a principal objective of the present invention to provide an interconnection method and apparatus for increasing signal transmission speeds through micro-electronic circuits.

It is a more specific objective of the present invention to provide an improved SCB transmission line network geometry which approaches an almost linear relationship between the length of the transmission line and the signal delay through the transmission line.

It is another objective of the present invention to provide an interconnection method and apparatus which maximizes the signal transmission speed over a given distance, such that over this distance the transmission line is capable of modeling the signal transmission characteristics of a coaxial "lossless" transmission line.

It is a further objective of the present invention to provide a method and apparatus for increasing signal transmission times which achieves an optimum relationship between total resistance of the transmission line and its characteristic impedance.

It is an additional objective of the present invention to provide a plurality of micro-strip transmission line structures which can be readily fabricated and interconnected together in combination to achieve a high speed signal transmission path.

It is yet another objective of the present invention to provide a high speed transmission path for use in a variety of micro-electronic circuit applications, including applications with signal frequencies above $1GH_z$.

It is still another objective of the present invention to create a high speed transmission path which provides an optimized termination resistor effect that is distributed along the transmission path.

SUMMARY OF THE INVENTION

To achieve the foregoing objectives of the present invention, a method of optimizing the signal transmission between a signal source and a signal receiver is disclosed which includes the steps of providing a signal transmission path or transmission line structure which is "semi-lossy", nonhomogeneous and governed by a predetermined relationship between its length and its various electrical parameters.

A transmission line in this context is primarily an R-L-C line composed of two conductors having a loop resistance R, a loop inductance L, and a conductor to conductor capacitance C. For the convenience of further discussion, a loss factor can be defined as $$\alpha = \frac{R}{2}\sqrt{\frac{C}{L}}$$

Strictly speaking, a lossy line is one with $\alpha > 0$, and a lossless line is one with $\alpha = 0$. Practically and customarily, however, a line for micro-electronic assemblies is considered to be lossless for $\alpha << 1$ and lossy for $\alpha >> 1$.

Lossless lines are known to impose a delay on a signal traveling from the signal source to the signal receiver which can be calculated as $t_o = \sqrt{LC}$. This delay varies linearly with the length of the line and is equal to the delay which would be incurred by a light wave travelling through the same medium. Hence, this delay is the smallest delay which can be attained by any means.

Lossy lines, on the other hand, are known to impose a delay which can be approximately calculated as $t_\alpha = \sqrt{LC \cdot \alpha}$. This delay varies approximately with the square of the line length and can be significantly larger than the minimum delay $t_o$.

Lossless lines are known to require terminators, i.e., resistors whose value is equal or close to the characteristic impedance $$Z_o = \sqrt{\frac{L}{C}}$$

of the line. Terminators can be placed at either or both ends of a line. Without terminators, multiple signal reflections at both line ends would lead to intolerable signal distortions otherwise known as over-shorting, under-shooting, ringing, or bouncing. Lossy lines, on the other hand, are known to be free of such problems even when used without any terminators.

A transmission line according to the present invention is optimized for a fixed length in such a way that it shares with the loss-less line the property of minimal, linear delay and with the lossy line the property of zero bouncing without terminators. Thus, under the appropriate circumstances, a signal can travel through a micro-electronic assembly on a signal path designed according to the methods of the present invention at essentially the speed of light and without bouncing.

The possibility of using thin film lossy lines for propagating high speed pulses near the speed of light without terminating resistors has been discussed in the following references: U.S. Pat. No. 4,210,885, issued on July 1, 1980 to Chung W. Ho, entitled "Thin Film Lossy Line For Preventing Reflections In Microcircuit chip Package Interconnections"; and an article entitled "The Thin-Film Module As A High-Performance Semiconductor Package," by C. W. Ho, et. al., IBM J. Res. Develop., Vol 26, No. 3, May 1982, pgs. 286–296. However, as will be appreciated from the description below, the present invention provides several advantages not found in these references. For example, the present invention provides a way of increasing the transmission line length while still permitting propagation speeds approaching the speed of light. Additionally, a critical transmission line distance has been found in which the signal being received will precisely reproduce the waveform of the signal transmitted at the other end of the transmission line.

A transmission line optimized according to the methods of the present invention has a loss factor in the vicinity of 1 and could therefore be called "semi-lossy." It is important to understand that in most micro-electronic assemblies and particularly in SCB's the physical constraints are such that lossy lines can be made easily but lossless lines cannot be made at all. The lossy lines, however, can be upgraded to be semi-lossy lines by appropriate design. It is therefore a particular accomplishment of the present invention to provide a transmission line which can be produced even under the physical constraints of an SCB and which is still superior to either of the previously known lines, namely, the lossless and the lossy line.

The previous discussion implied that the lines considered, be they lossy, lossless, or semi-lossy according to the present invention, are homogeneous, i.e., that the electrical parameters R,L,C if normalized per unit of length do not change over the length of the line. Nonhomogeneous lines, on the other hand, are lines in which these parameters do change, either abruptly at certain points or continuously along the line.

The methods of the present invention make use of nonhomogeneity in order to either increase the fixed length for which optimization can be performed or to ease the physical construction of micro-electronic transmission lines at lesser distances. Particularly in SCB's, nonhomogeneous lines are applied in such a way, that they simultaneously serve the purposes of implementing programmable routing and enhancing signal transmission characteristics. For example, in a transmission line network where optimization cannot be achieved, the use of nonhomogeneous lines according to the present invention can still provide improvements in transmission speeds.

In one form of the present invention, a nonhomogeneous signal transmission path is constructed from a plurality of different micro-strip conductors which are connected together for transmitting a signal in a particular direction. Preferably, three sets of micro-strip conductors of varying width are formed in two separate planes of a substrate structure which will enable interconnections to be made between these conductors. The two planes have distinctly different altitudes over a common ground plane which is used as a common current return path for all conductors in the structure. Specifically, the widest conductor is placed into the upper plane and connected to the signal source, the narrowest conductor is also placed into the upper plane but connected to the signal receiver, and the conductor of intermediate width is placed into the lower plane and used to interconnect the other two conductors together.

It should be appreciated that the principals of the present invention are susceptible for use in a variety of micro-electronic circuits and other applications involving transmission lines whose characteristics can be optimized in accordance with the present invention. Thus, for example, the present invention can be used in a wide range of interconnection technologies, even within the IC chips themselves.

Additional advantages and features of the present invention will become apparent from reading the detailed description of the preferred embodiments which make reference to the following set of drawings.

DESCRIPTION OF THE PREFERRED EMBODIMENTS

Figure 1:
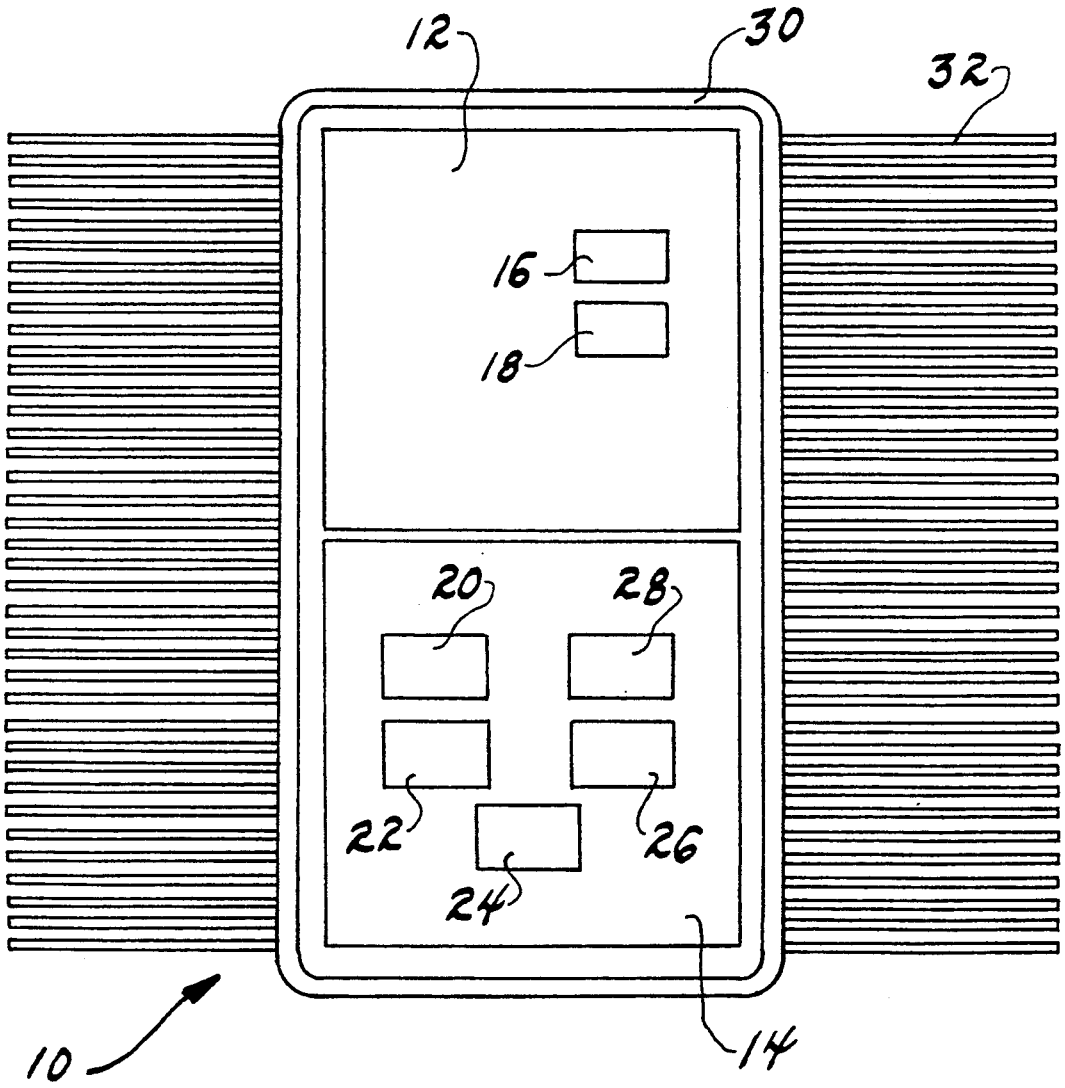
FIG. 1 is a plan view of a SCB structure whose general layout is applicable to the method and apparatus according to the present invention.

Referring to FIG. 1, a plan view of an SCB 10 is shown. While the general layout of the SCB 10 is applicable to the method and apparatus according to the present invention, it should be appreciated that the principles of the present invention are not limited to this particular SCB structure or any SCB structure. As will be appreciated from the description below, the present invention is applicable to a wide variety of micro-electronic circuit interconnection technologies. Accordingly, while the present invention is particularly applicable for use in SCB structures, the SCB structures described below are set forth for exemplary purposes only.

The SCB 10 is fabricated using a thin silicon wafer as a substrate or base for the composite SCB structure. The SCB 10 provides a pair of generally square sections or segments 12 and 14 for mounting a plurality of IC chips to the SCB substrate. For example, FIG. 1 shows IC chips 16 and 18 which are wire bonded to the segment 12 of the SCB 10. Similarly, FIG. 1 also shows a set of five IC chips 20–28 which are wire bonded to the section 14 of the SCB 10. As will be discussed below in connection with FIG. 2, the SCB 10 provides a matrix of micro-strip conductors whose interconnections are programmed to provide a network of signal transmission paths between the appropriate IC chips mounted to the SCB substrate. The combination of the SCB 10 with the IC chips (such as chips 16–18 and 20–28) provide a hybrid circuit and wafer assembly which can be used in virtually any electronic circuit application.

The silicon wafers of the segments 12 and 14 are mounted to a header assembly 30. The header assembly 30 provides several input and output lines 32 which extend to the periphery of the SCB 10. Accordingly, the periphery of the SCB 10 provides a connector junction for interfacing the SCB to other circuits and devices.

Figure 2:
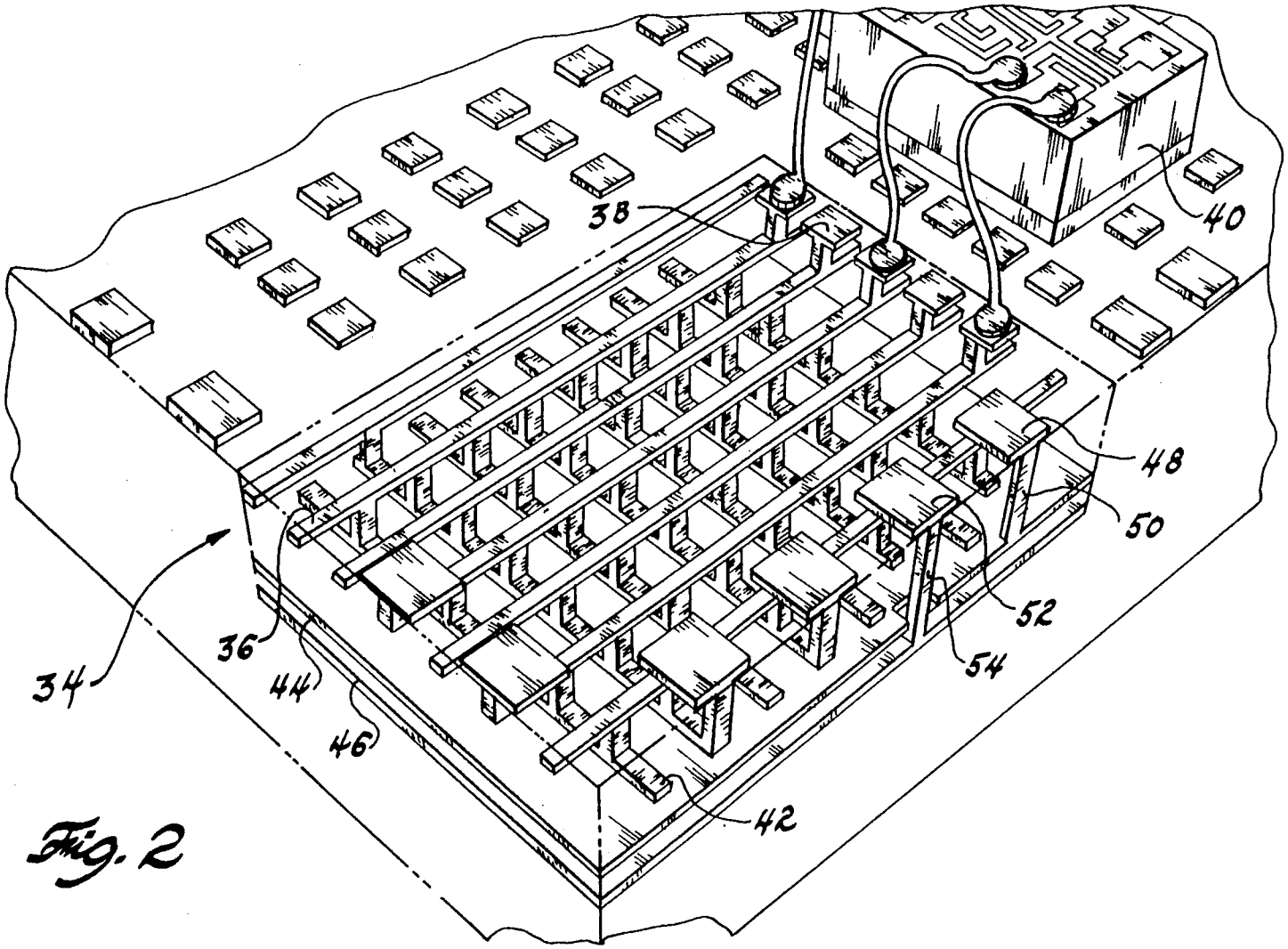
FIG. 2 is an artist's conception, in perspective, of a general SCB layout for purposes of illustration.

Referring to FIG. 2, an artist's conception of an SCB section or cell 34 is shown in a way which illustrates the matrix of micro-strip conductors used in the SCB structure. It should be understood that this Figure is not intended to depict an actual SCB structural design. Rather, FIG. 2 is being used to illustrate the basic elements used in an SCB structure. As shown in FIG. 2, the SCB section 34 includes a fist set of micro-strip conductors 36 which are aligned in parallel along one horizontal plane of the SCB. The microstrip conductors 36 are generally referred to as "pad" lines, as each of these lines is provided with at least one bonding pad 38. The bonding pads 38 are used to connect IC chips, such as the IC chip 40, to the network of micro-strip conductors provided in the SCB. In this regard, conventional wire bonding techniques can be used to connect an appropriate lead of the IC chip with the pad of an appropriate microstrip line conductor 36.

Figure 7:
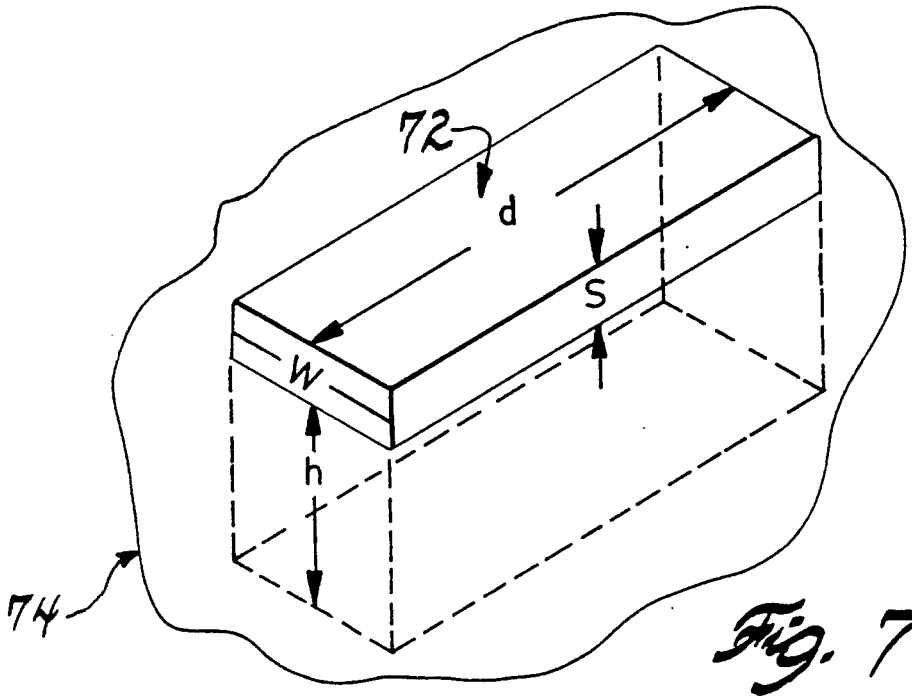
FIG. 7 is a drawing of a micro-strip line example of transmission line according to a method of the present invention for controlling the relationship between the total resistance of the line and its characteristic impedance.

The SCB section 34 also includes a second set of micro-strip conductors 42 which are aligned in parallel along a horizontal plane which is beneath the plane used for the pad lines 36. The micro-strip conductors 42 are generally referred to as "net" lines, as they provide the necessary links to create a signal transmission path network through the SCB. Since the net lines 42 may be used to transmit a signal to a plurality of receivers, these lines may generally be wider than the pad lines 36. This difference in width between pad lines and net lines is illustrated in FIG. 7 of U.S. Pat. No. 4,458,297, which has previously been incorporated by reference. It should also be noted that more than one plane of pad lines 36 and/or net lines 42 may be provided in an appropriate SCB structure.

The pad lines 36 are separated from the net lines 42 at their cross-over points by a continuous layer of an amorphous silicon material ($SiO_2$), which is more fully described in the Ronald G. Neale U.S. Pat. No. 3,675,090, issued on July 4, 1982, entitled "Film Deposited Semiconductor Devices," which is hereby incorporated by reference. One unique characteristic of this amorphous silicon material is that it has the ability to act as an electronic switch or "anti-fuse." More specifically, the amorphous silicon material is capable of switching from a normal insulating state (e.g., $>200$ MΩ) to an electrically conductive state (e.g., $<5$ Ω). This switching is achieved by electrically "firing" individual cross-over points or bridges between selected pad and net lines. Specifically, a threshold voltage (e.g., approximately 20 volts) is applied across the amorphous silicon bridge which will cause the amorphous silicon to switch to a stable conductive state.

Accordingly, it should be appreciated that this switching ability enables selected pad lines 36 to be interconnected to selected net lines 42 through an electrical programming process to create a desired network of signal transmission paths through the SCB. In this regard, the amorphous silicon material has been referred to as an "anti-fuse," because it is normally an insulator, whereas a fuse is normally a conductor. However, it should be understood that other suitable semiconductor materials may be used in the place of the amorphous silicon material, as long as they have the ability to switch between conductive and nonconductive states. Thus, for example, certain amorphous chalcogenide materials have been suggested for the purpose.

FIG. 2 also illustrates that the SCB section 34 includes a pair of conductor planes 44 and 46. These conductor planes are used to provide electrical power connections for the SCB structure. The conductor plane 44 is preferably used as the ground plane, while the conductor plane 46 is preferably used as the voltage plane. However, it should be appreciated that the role of these two conductor planes could be reversed in the appropriate application. Each of the conductor planes 44 and 46 are preferably made out of aluminum, as are the micro-strip conductors 36 and 38. However, other suitable electrically conductive materials may be used in the appropriate application.

Each of the conductor planes 44 and 46 are provided with a plurality of pads for enabling the appropriate power connections to be made with each of the IC chips wire bonded to the SCB structure. For example, FIG. 2 illustrates a pad 48 which is connected to the conductor plane 44 through a pedestal 50. Similarly, FIG. 2 illustrates a pad 52 which is connected to the conductor plane 46 through a pedestral 54. The conductor plane 46 is preferably formed on a thin silicon wafer which extends across the entire matrix of micro-strip conductors used in the SCB.

In general, it is a goal of the present invention to increase the signal transmission speed in otherwise lossy transmission paths, such as a Thomson Cable transmission line, while avoiding the requirement of a termination resistor. Such an increase in the signal transmission speed is particularly advantageous in an SCB interconnection network, since the delay has been found to be proportional to the square of the length of the micro-strip conductors. Thus, for example, if it is assumed that a particular lossy transmission line has a delay T for one-third of the total length of the line, then the transmission delay over the entire length of the line would be nine times T. However, in accordance with the present invention, the design parameters of the signal transmission paths in an SCB interconnection network can be optimized so as to substantially reduce the transmission delay times. Additionally, the signal transmission paths according to the present invention can be used to carry signals of extremely high frequencies (e.g., greater than $1GH_z$).

It will, of course, be appreciated that in most SCB applications, interconnections will not always be made at the extreme ends of the lines, and that a line may also have two or more orthogonally directed lines connected across its length. Accordingly, these line loading effects will make it difficult to accurately determine the propagation delays through an interconnected network without actual testing or speed simulations. Nevertheless, the present invention provides two complementary techniques for substantially reducing the transmission delays which achieve surprising results. For example, it will be shown that there is a critical line length which will enable the waveform of the transmitted signal to be precisely reproduced at the receiver on the first transition.

Figure 3A:
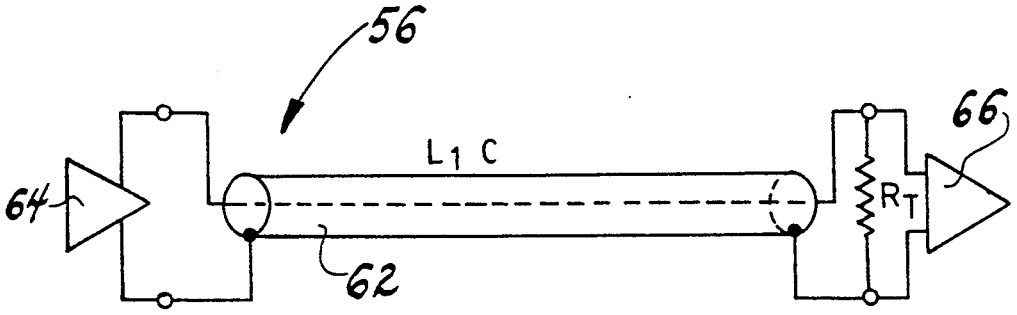
FIG. 3A–3C are schematic circuit diagrams of electrically long, single phase, transversal electromagnetic transmission lines which are lossless (A), piecewise approximated lossy (B), or semi-lossy (C).
Figure 3B:
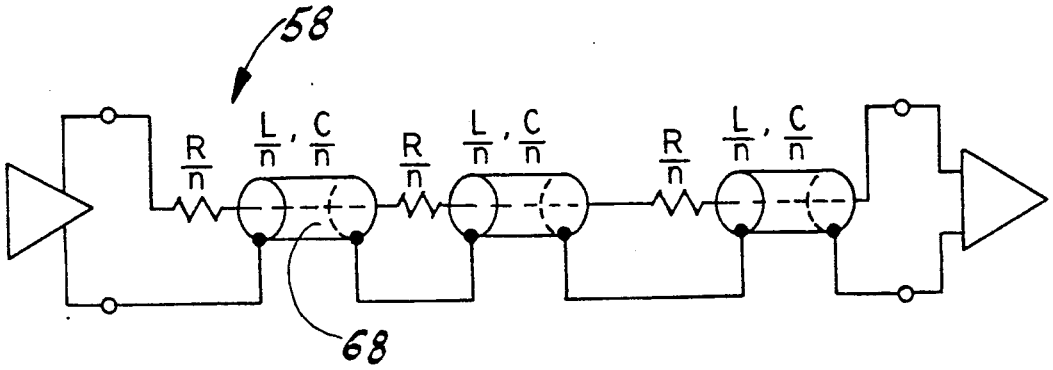
Figure 3C:
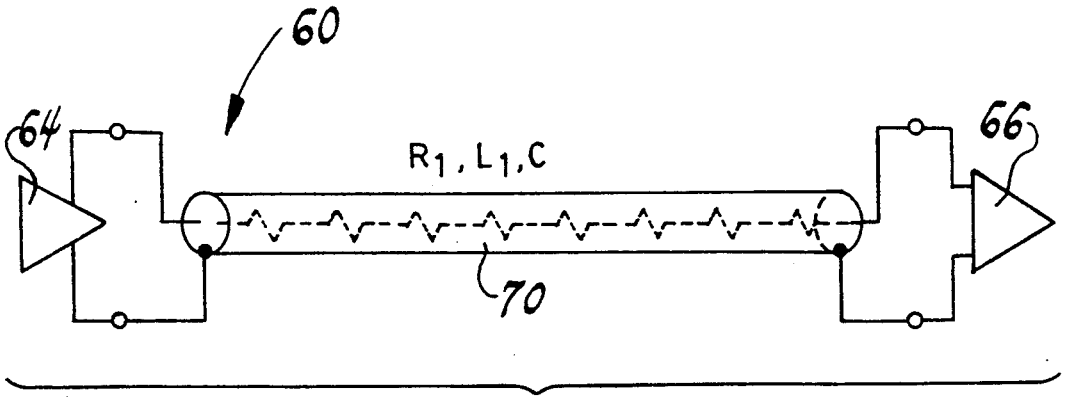

FIGS. 3A-3C show schematic diagrams of three transmission line circuits 56-60. FIG. 3A is drawn around a length of coaxial cable 62 which is a classical example of a single-phase, transverse electromagnetic (TEM) transmission line. The coax cable 62 serves only as an example and the transmission characteristics explained below are equally applicable to any other conductor pair which can sustain TEM waves, particularly a micro-strip over a ground plane. The coax cable 62 is presumed to have an inductance L and a capacitance C, but no resistance. A signal put on the line by the signal generator or source 64 arrives at the signal receiver 66 after a time delay $t_o=\sqrt{LC}$. The signal may see an amplitude modification A at the receiver end which is governed by the value of the terminating resistor $R_T$ as follows:

$$A = \frac{2R_T}{Z_o + R_T}, \text{ where } Z_o = \sqrt{\frac{L}{C}}$$

Ideally, $R_T$ is equal to $Z_o$ which leads to $A=1$. For larger or smaller values of $R_T$, the line shows ringing. In the extreme cases of $R_t=0$ or $R_T=\infty$, the signal bounces back and forth between the end points of the line forever.

FIG. 3B shows a piece-wise approximation of a line with not only distributed inductance and capacitance but also with distributed resistance. At the end of each cable section 68, a partial signal reflection will take place and the resulting amplitude (the sum of the arriving and the returning signal) will be modified by a factor which follows the same rule which is valid for the end of the line in FIG. 3A, except that $R_T$ has to be replaced by the load represented by the following line section. This load, including the series resistor R/n, is equal to $R/n + Z_o$, except for the last section where the load "resistor" is infinite. At the same time, there will be a voltage reduction at each input of a line section 68 because the series resistor R/n and the line input resistance $Z_o$ comprise a voltage divider. Thus, the original signal supplied by the signal generator is increased or decreased at each junction as it travels down the line and has experienced a total amplitude modification when it arrives at the signal receiver which can be expressed by the factor $$A_n = \left[\frac{2\left(\frac{R}{n} + Z_o\right)}{Z_o + \frac{R}{n} + Z_o}\right]^{n-1} \cdot 2 \cdot \left[\frac{Z_o}{R/n + Z_o}\right]^n$$

With the introduction of a loss factor $$\alpha = \frac{R}{2Z_o} = \frac{R}{2}\sqrt{\frac{C}{L}}$$

this equation can be rewritten as $$A_n = \frac{1 + \alpha/n}{1 + 2\alpha/n} \cdot \frac{2}{(1 + \alpha/n)^n}$$

The initial waveform travelling down the line creates reflections at the each of each line section 68 which in turn create more secondary reflections. However if "n" is a large number, the numerous but individually small reflections add up in such a way that their sum is slowly moving smooth curve which provides the transition from the initial response delineated by the above factor A to the final response. It is important to note that the time required by the initial waveform to reach the signal receiver is equal to that found in the lossless line of FIG. 3A because the sum of the lengths of the "n" sections is equal to the length of the whole line, hence again $$t_o = \sqrt{LC}$$

FIG. 3C shows an R.L.C. line 70 with a truly distributed resistance. Its amplitude transfer function can be derived from the previous case by growing "n" to infinity:

$$A = \lim_{n\to\infty} Z \cdot \frac{1 + \alpha/n}{1 + 2\frac{\alpha}{n}} \cdot \left(1 + \frac{\alpha}{n}\right)^{-n} = 2e^{-\alpha}$$

Again, a replica of the original signal from the signal generator 64 with a scaling factor A is presented to the signal receiver 66 after the minimum delay time of $t_o=\sqrt{LC}$. After the arrival of the replica, additional slow responses follow which become negligible as A approaches 1. In other words, when $A=1$, the waveform of the transmitted signal will be reproduced at the receiving end of the line without any adverse reflections being generated. For example, with a step signal being transmitted down the line, this step function will be reproduced at the receiving end with a sharp rise and little or no tail.

An optimized line can thus be defined as a line which is characterized by $A=1$ which, in the case of the most simple implementation with only one homogeneous line, is synonymous with $\alpha=\ln 2$ or $R=2$ (ln2) $Z_o=1.39Z_o$. This means that the optimized, semi-lossy, unterminated line 70 duplicates the behavior of the terminated, lossless line. This optimization is related to a fixed distance in as much as R is a function of distance or line length while $R_T$ is not. It should be appreciated that a fixed line length in the context of an SCB is not a restriction but a design parameters. Another way of describing the optimized line is to say that the discrete terminator $R_T=Z_o$ has been replaced by a distributed terminator $R=1.39Z_o$.

The concept of the optimized line can be illuminated further by the following design example. FIG. 7 shows a micro-strip line 72 with a width w, a thickness s, a height h over the ground plane 74, and a length d. The resistance of line 72 can be calculated as $$R = \delta\frac{d}{w \cdot s}$$

and the characteristic impedance $Z_o$ can be calculated as $$Z_o = K \cdot \frac{h}{w} \cdot \frac{377\Omega}{\sqrt{\epsilon_r}}$$

$\delta$ is the resistivity of the conductor material. $\epsilon_r$ is the permittivity of the dielectric between the conductors. K is the fringe field correction factor which can be approximated as $$\frac{1}{K} \simeq 1 + \frac{2h}{\pi w}\left[1 + \text{Ln}\left(1 + \frac{\pi w}{2h}\right)\right]$$

and which usually ranges between 0.5 and 0.9. If $\delta=3\times10^{-8}\,\mu\text{m}$ (aluminum), $\epsilon_r=4$ (silicon dioxide), and K is assumed to be 0.7 for simplicity, then the dimensions of the micro-strip may be optimized as follows:

$$R = 1.39Z_o$$

$$\delta\frac{d}{ws} = 1.39 \cdot K \cdot \frac{h}{w} \cdot \frac{377\Omega}{\sqrt{\epsilon_r}}$$

$$h \cdot s = (0.16 \cdot 10^{-9}m)d$$

If the desirable length d of the lines on an SCB is 40 mm, the design requirements are reduced to $h \cdot x = 6.54\ (\mu m)^2$. An example of a design which would satisfy this equation would be $S = 2\ \mu m$, $h = 3.27\ \mu m$.

It should be noted that this optimization is not overly sensitive to variations from the ideal condition of $R = 1.39\ Z_o$. Depending on pulse rise times, this ideal condition can be missed by a factor on the order of 1.5 without substantial performance degradation. However, variations from the ideal condition will cause the amplitude modification factor A to change from $A = 1$, such that a precise replica of the signal waveform will not be achieved.

Figure 4A:
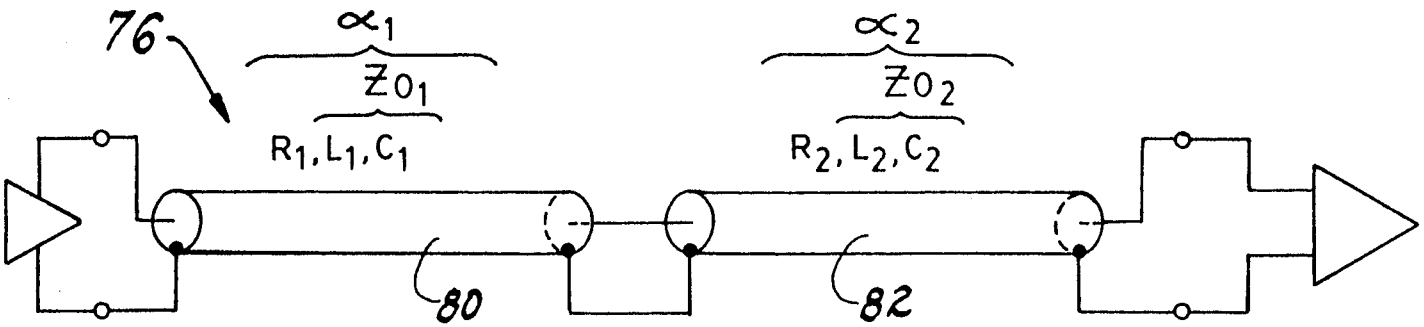
FIGS. 4A–4B are diagrammatic representations of nonhomogeneous transmission line structures according to the present invention.
Figure 4B:
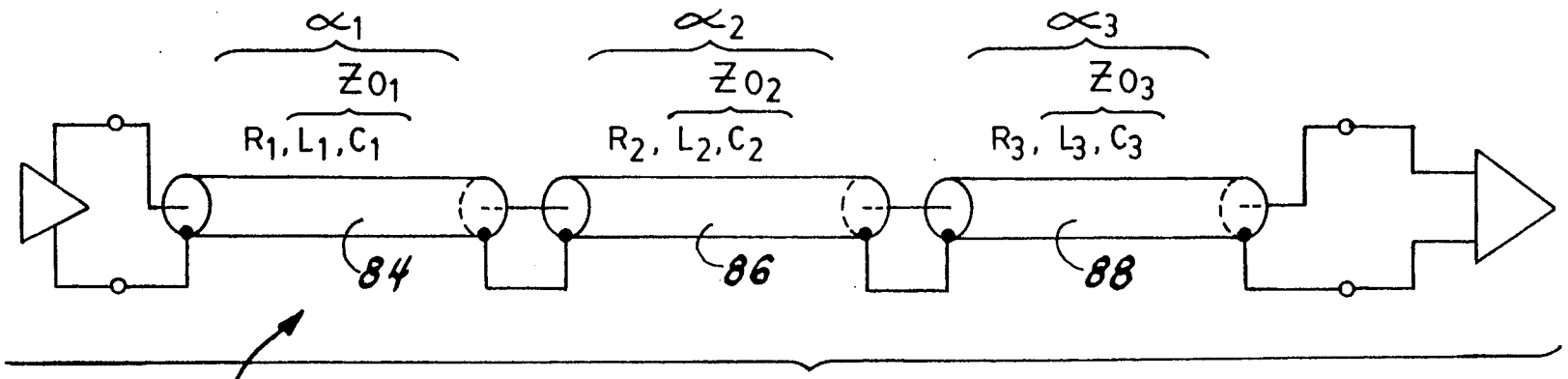

FIG. 4A and 4B show two examples of non-homogeneous transmission line circuits 76–78. The transmission line of FIG. 4A is comprised of two series connected or cascaded sub-lines 80–82 which are homogeneous in themselves. Similarly, the transmission line of FIG. 4B is comprised of three sub-lines 84–88 which are homogeneous in themselves. While these two transmission line structures are preferred embodiments of the present invention, it should be understood that the principals of using nonhomogeneous lines is not restricted to any particular number of sub-lines or even any identifiable sub-lines which are homogeneous in themselves.

The sub-lines 80–82 in FIG. 4A by themselves behave like a homogeneous transmission line except that the reflection-related voltage increase at the end of the first line is $$\frac{2\ Z_{o2}}{Z_{o1} + Z_{o2}} \text{ instead of 2.}$$

instead of 2.

Therefore, the total amplitude transfer factor is $$A = 4 \cdot \frac{Z_{o2}}{Z_{o1} + Z_{o2}} \cdot e^{-(\alpha 1 + \alpha 2)}$$

It can now be seen, that optimization ($A = 1$) can be reached for attenuation values which are larger than in the case of the homogeneous line, provided that $Z_{o2} > Z_{o1}$.

In one preferred embodiment of an SCB according to the present invention, the impedance relation is $Z_{o2} = 2Z_{o1}$, the loss factor relation is $\alpha_1 = \alpha_2 = \alpha$ and, hence, $$A = \frac{8}{3} e^{-\alpha}$$

From this optimization equation follows $\alpha = 0.98$. Thus, $\alpha$ has been improved over the homogeneous case by a factor of $0.98/0.69 = 1.42$. An improved (increased) $\alpha$ means that the length of the line can be increased for the same cross section or that the cross section can be made easier to manufacture for the same line length.

Since optimization according to the present invention is based on the manipulation of the first pulse or signal transition arriving at the end of the line, it is necessary that the two sub-lines are equally long. If they are not, the optimized loss factor will be somewhere between 0.98 and 0.69, and the improvement will be accordingly smaller.

The line of FIG. 4B, is analyzed similarly, yields $$A = 8 \cdot \frac{Z_{o2}}{Z_{o1} + Z_{o2}} \cdot \frac{Z_{o3}}{Z_{o2} + Z_{o3}} \cdot e^{-(\alpha 1 + \alpha 2 + \alpha 3)}$$

Again, improvements can be gained if $Z_{o3} > Z_{o2} > Z_{o1}$ In One embodiment of an SCB, parameters are chosen such that $Z_{o3} = 2Z_{o2} = 3Z_{o1}$, $\alpha_1 = \alpha_2 = \alpha_3 = {}_3\alpha$, and hence $$A = \frac{16}{5} e^{-\alpha}$$

Optimization ($A = 1$), in this case, leads to $\alpha = 1.16$.

While FIGS. 4A and 4B illustrate non-homogeneous transmission lines having two and three sub-lines or sections respectively, the following equations may be used to generally characterize the amplitude transfer factor for a non-homogeneous transmission line. If it is assumed that $Z_o$ of the first subsection is called $Z_a$ and that both R/n and $Z_o$ of the following subsections are increased from subsection to subsection by a factor F (which implies that the attenuation factor per subsection remains constant), then:

$$\frac{\alpha}{n} = \frac{F^i \cdot R/n}{\cdot 2F^i Z_a} = \frac{1 \cdot R}{n \cdot 2Z_a}$$

Accordingly, the equation for $A_n$ now becomes:

$$A_n = \left[\frac{2(R/n + Z_a)F^i}{(R/n + Z_a)F^i + Z_a F^{i-1}}\right]^{n-1} \cdot \left[\frac{Z_a F^i}{(R/n + Z_a)F^i}\right]^n \cdot 2$$

$$A_n = \frac{1/2 + 1/2F + \alpha/n}{1 + 2\alpha/n} \cdot \frac{2}{(1/2 + 1/2F + \alpha/n)^n}$$

The relations become clearer if one substitutes $$\frac{1}{F} = 1 - \frac{2\beta}{n}$$

and obtains $$A_n = \frac{1 + (\alpha - \beta)/n}{1 + 2\alpha/n} \cdot \frac{2}{(1 + (\alpha - \beta)/n)^n}$$

or $$A = \lim_{n \to \infty} A_n = 2e^{-(\alpha - \beta)}$$

The difference between the non-homogeneous and the homogeneous line is then that the attenuation factor $\alpha$ is reduced by an amount $\beta$. If $Z_o$ of the last subsection is called $Z_B$, the equation for 1/F can be transformed into $$\frac{Z_B}{Z_A} = F^{n-1} = \lim_{n \to \infty} F^{n-1} = \lim_{n \to \infty} \frac{1}{(1 - 2\beta/n)_{n-1}} = e^{2\beta}$$

This means that the characteristic impedance grows exponentially over the length of the line from $Z_A$ to $Z_B$ with a growth factor $$2\beta = \mathrm{Ln}\frac{Z_B}{Z_A}$$

The critical distance can now be redetermined such that $A=1$, and a "stretch factor" $s_c$ can be obtained by dividing the new critical distance over the old one:

$$S_c = 1 + \frac{\mathrm{Ln}\ Z_B/Z_A}{2\mathrm{Ln}2}$$

With $Z_B/Z_A=4$, for instance, $s_c=2$. This means that ideal transmission conditions are now bound for lines with the length $2d_c$ rather than $d_c$.

In practice, it may be desirable to grow $Z_o$ not exponentially but rather in one or two discrete steps, which will reduce the stretch factor slightly. Thus, for example, with two steps and $Z_B/Z_A=4$, then $S_c=1.83$.

Since $\beta$ subtracts from but does not divided into $\alpha$, the stretch factor decreases with increasing line length but not as drastically and as far as suggested by the equation for "A" set forth above, because of the not yet considered secondary component. In this regard, the summated effect of all the reflections and re-reflections on the line output signal is referred to as the secondary component. In contrast, what reaches the end of the line first may be called the primary component of the output signal.

Figure 5:
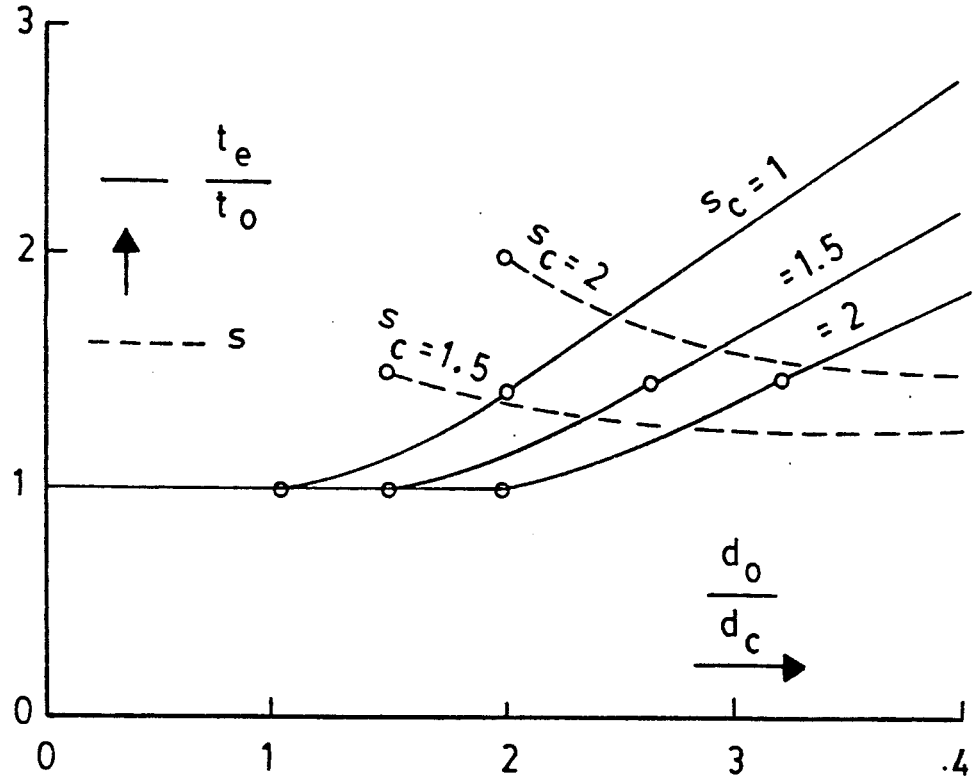
FIG. 5 is a graph illustrating relative time delays for homogeneous and non-homogeneous lossy lines versus a homogeneous lossless line.

FIG. 5 shows stretch factors obtained by simulation and their effect on $t_e$ as a function of $d_o$. In this regard, $t_e$ is the end of line delay, $d_o$ is the total distance, and $d_c$ is the critical distance. The overall result is that lossy lines can be made quite effective up to at least $3d_c$ by suitable impedance control.

In order to provide proper distributed termination for very short lines, the above process can be reversed: inverse impedance ratios shrink $d_c$.

It should be understood that a nonhomogeneous line according to the present invention will permit an increase in the optimized length as long as $Z_o$ increases in he direction from the signal generator to the signal receiver. Accordingly, the particular relationships between the characteristic impedances of the sub-lines shown above are intended to be used only for illustrative purposes.

It is further important to understand that the nonhomogeneous line affords smaller delay times even if it exceeds slightly or substantially differs from the optimization value. Thus, even when it is not possible to achieve an optimized transmission line structure ($A=1$) in a particular application, a non-homogeneous construction may be employed to substantially reduce the transmission delay for signal transmissions in a particular direction. For example, while homogeneous "lossy" transmission lines in an SCB have a delay which is proportional to the square of the line length, an almost linear relationship between the transmission delay and the line length can be achieved with a directionally specific nonhomogeneous or cascaded transmission line within the distance constrains discussed above.

Specifically, a plurality of signal conductor lines or line sections may be interconnected together in a way which will cause $Z_o$ to increase in the direction from the signal generator to the signal receiver. One way in which the variation in $Z_o$ may be achieved is to provide signal conductor lines of varying width, with the widest line being connected to the signal generator and the thinnest line being connected to the signal receiver. Of course, it will be appreciated that other suitable construction techniques may be employed in the appropriate application to achieve the desired variation in $Z_o$. However, in one form of an SCB according to the present invention, conductor lines of varying width are deposited or formed on two different planes of the structure to facilitate connections with one or more IC chips.

Figure 6:
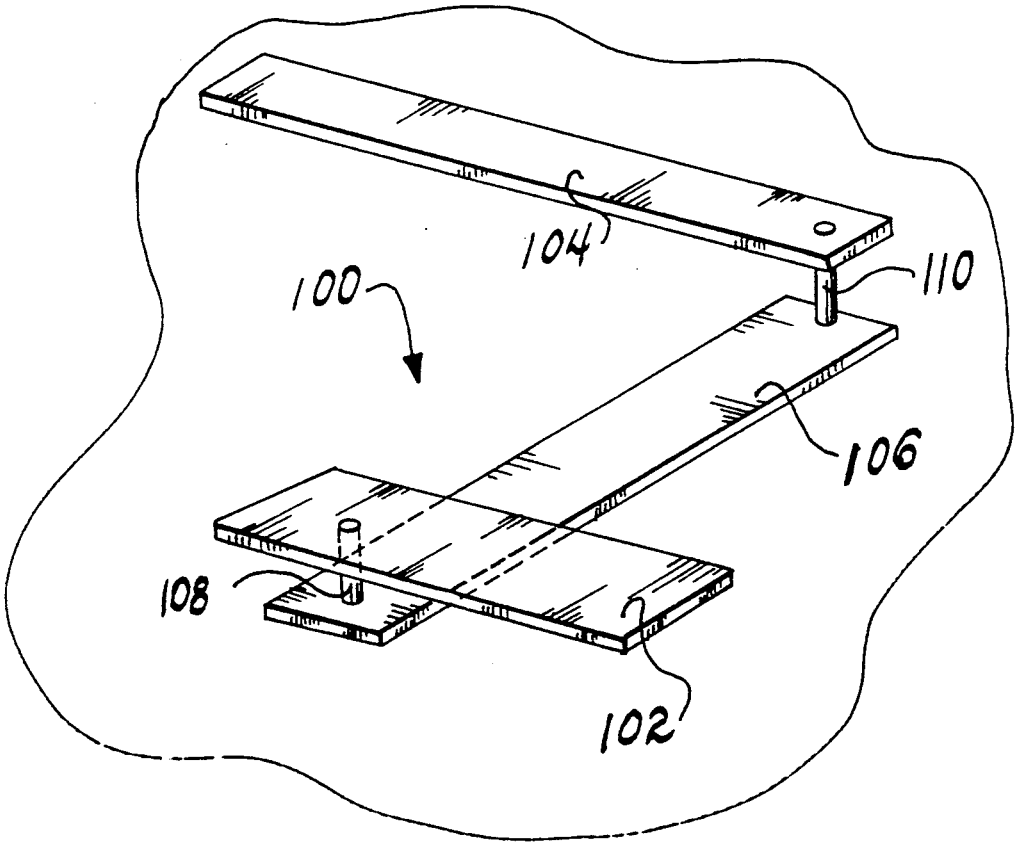
FIG. 6 is a diagrammatic representation of a nonhomogeneous micro-strip conductor structure formed in two planes according to one embodiment of the present invention.

In this regard, FIG. 6 shows an interconnected conductor network 100 in which the widest conductor 102 is disposed on the same plane that the thinnest conductor 104 is disposed on. The conductors 102 and 104 are interconnected by the conductor 106 of intermediate width which is disposed on a plane below these two conductors. Any suitable means may be used to interconnect these conductors, such as amorphous silicon bridges 108 and 110. With this construction, it will be appreciated that both the conductors 102 and 104 are readily accessible to one or more IC chips which may be disposed in the vicinity above them. Thus, for example, a signal generator and a signal receiver may be disposed on the same IC chip or on different IC chips.

FIG. 6 also shows that the conductor 102 is orthogonal to the conductor 106, and that the conductor 106 is orthogonal to the conductor 104. This orthogonality permits logic nets to be created for interconnecting various IC chips disposed on the SCB substrate. However, it should be appreciated that other suitable angular relationships between the various conductors in the SCB matrix may be employed in the appropriate application. It should also be noted that the conductor 102 is shorter than the conductors 104 and 106. The use of such a short and fat conductor 102 is advantageous from the standpoint of the topology of an SCB strip-line conductor matrix. Since the strip-line conductors in an SCB matrix typically run across the entire length of the wafer, the use of a long and wide conductor would consume a substantial amount of space on the top interconnection plane of the SCB. However, by making the widest conductors very short (e.g., ⅓ of the normal length), it will be much easier for an SCB designer to permit a sharing of the space between the widest and thinnest conductors on a single plane. While it would be more desirable to have the widest conductor 102 on a plane which is between that of the conductor 106 and the ground path from the standpoint of capacitive coupling, this difference can be made up by an appropriate adjustment to the width and/or height of the conductor 102.

It should be noted that the conductor network 100 will decrease signal transmission delays, even though the RC coupling of the individual conductors 102–106 with the ground plane is the same. Thus, for example, the width and height of the conductors 102–106 can be constructed such that each of these conductors will provide the same RC time constant. However, as shown above the increase in speed is due to the change in impedance through the conductor network 100. Specifically, as a signal is transmitted from conductor 102 to conductor 104, the impedance level increases and correspondingly the load decreases.

Figure 8:
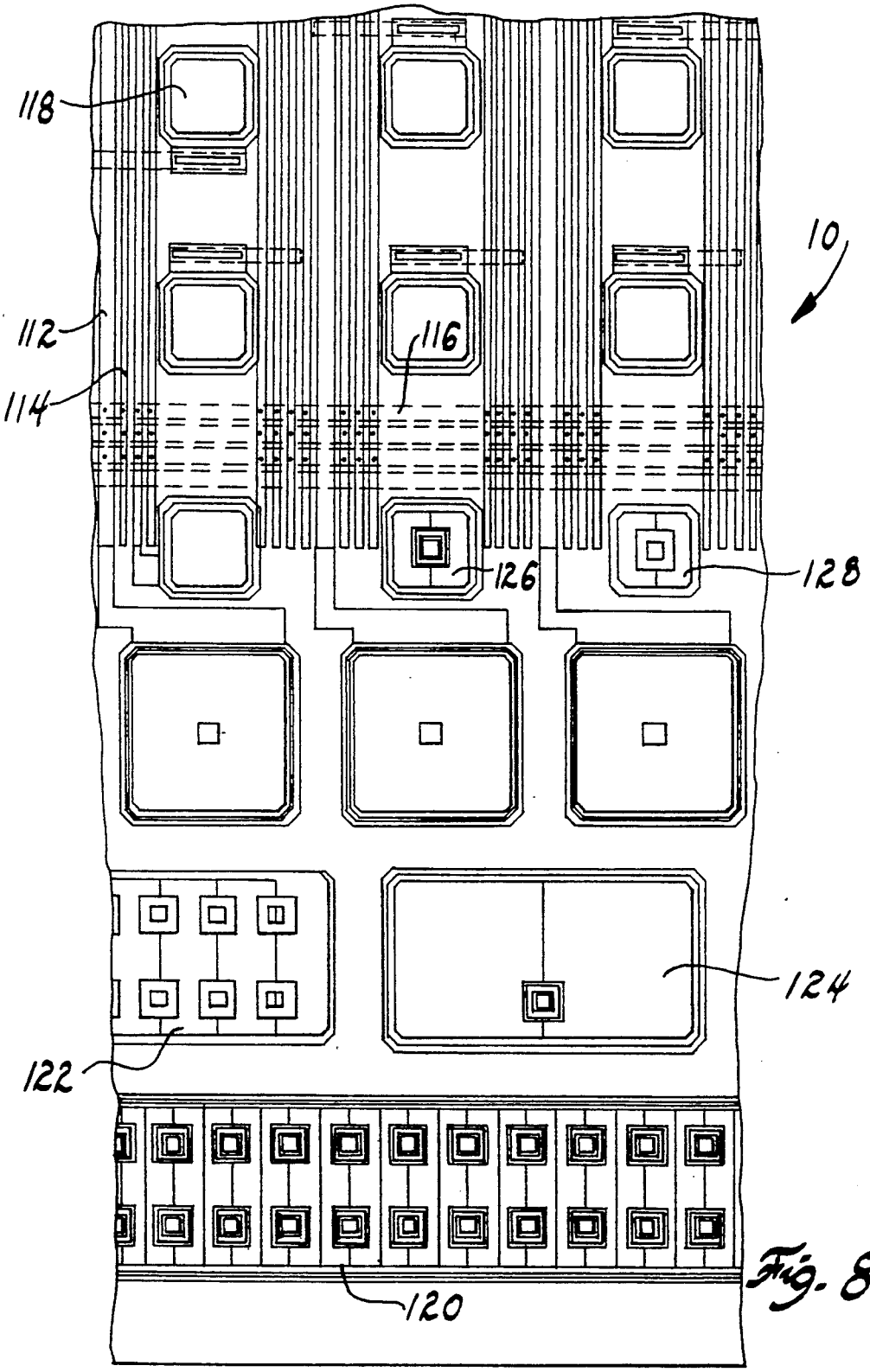
FIG. 8 is an enlarged top elevation view of a portion of the SCB shown in FIG. 1.

Referring to FIG. 8, an enlarged top view of a portion of the CB 10 of FIG. 1 is shown. FIG. 8 illustrates one possible form of an SCB structure which generally utilizes the type of conductor network shown in FIG. 6. Specifically, a plurality of relatively short and wide micro-strip conductors 112 and plurality of relatively long and thin micro-strip conductors 114 run parallel to each other and are disposed on the same plane of the SCB 10. Additionally, SCB 10 includes a plurality of micro-strip conductors 116 which are orthogonal to conductors 112–114, and which are disposed on a plane below that of the conductors 112–114. Amorphous silicon dioxide vias or bridges are used to provide programmable interconnections between these conductors at cross-over points shown as dots in FIG. 8.

Each of the conductors 112–114 are connected to at least one of the plurality of pads 118 which are used to facilitate connections between the IC chips and the appropriate conductors of the SCB. Accordingly, it should be appreciated that one or more of the conductors 112 may be connected to a signal generator and one or more of the conductors 114 may be connected to a signal receiver. Then, the appropriate amphorous silicon dioxide bridges may be programmed to interconnect the conductors 112 and 114 together. In this regard, any suitable means may be employed to program these interconnections (e.g., through electrical, optical or thermal processes).

FIG. 8 also illustrates that the SCB 10 includes a plurality of signal input and output pads 120–122, as well as test pads 124. Additionally, the SCB 10 includes a plurality of voltage and ground pads 126–128 which are disposed at various places along the top surface of the SCB to enable power connections to be made with the IC chips. It should be appreciated that FIG. 8 illustrates only one possible topology, and that other suitable SCB topologies may be employed in the appropriate application.

The various embodiments which have been set forth above were for the purpose of illustration and were not intended to limit the invention. It will be appreciated by those skilled in the art that various changes and modifications may be made to these embodiments described in this specification without departing from the spirit and scope of the invention as defined by the appended claims.

What is claimed is:

1. A micro-strip transmission line structure for facilitating high speed signal transmissions in a lossy transmission line network, comprising:

a plurality of interconnected nonhomogeneous micro-strip signal paths and an electrically conductive return path formed on a wafer-based substrate, at least one of said nonhomogeneous micro-strip signal paths having construction means for providing a predetermined ratio between its electrical resistance and the characteristic impedance of the transmission line structure which will reproduce the transmitted signal at a reception end of said signal path with an amplitude transfer function "A" substantially equal to one;

said one nonhomogeneous micro-strip path being comprised of a plurality of interconnected homogeneous conductor sections in which the characteristic impedance associated with each section increases in the direction of the signal transmission.

2. The transmission line structure according to claim 1, wherein each of said homogeneous conductor sections are substantially equal in length.

3. The transmission line structure according to claim 1, wherein at least two of said homogeneous conductor segments are disposed on different planes.

4. A transmission line structure, comprising:

a plurality of signal conductors in a wafer-scale interconnection network which are interconnected in series on different planes of said interconnection network to permit signal transmission in a particular direction, each of said signal conductors having construction means for providing a distributed resistance which has a predetermined relationship with the characteristic impedance of the transmission line structure, said predetermined relationship enabling the waveform of a transmitted signal to be reproduced at the signal receiving end of said plurality of signal conductors with substantially no modification in amplitude;

a ground conductor plane disposed in a fixed physical relationship with said signal conductors;

said transmission line structure including three signal conductors having different widths;

said signal conductors and said ground conductor plane being supported by a substrate, with only two of said three signal conductors being formed on a first plane of said structure, and said ground conductor plane being formed on a second plane of said substrate.

5. The transmission line structure according to claim 4, wherein programmable semiconductor means is interposed between each of said signal conductors for permitting interconnections to be made between said signal conductors.

6. A structure for facilitating high speed signal transmissions from a signal source to a signal receiver through a lossy transmission line network, comprising:

a first conductor, a second conductor and ground conductor disposed in a fixed physical relationship with each other, such that said first conductor is connected to said signal source, said second conductor is connected to said signal receiver, and said first conductor is connected to said second conductor through a programmable semiconductor switch, and said first conductor providing a characteristic impedance which is greater than that provided by said second conductor;

a third conductor disposed in a physical relationship with the other conductors such that said third conductor is interconnected between said first and second conductors, said third conductor having a characteristic impedance which is greater than the characteristic impedance of said first conductor and less than said second conductor.

7. The structure according to claim 6, wherein said first and second conductors are formed on a plane which is distinct from the plane on which said third conductor is formed, said first and third conductors are orthogonal to each other.

8. The structure according to claim 7, wherein the plane of said first and second conductors is above the plane of said third conductor, and the plane of said third conductor is above the plane of said ground conductor.

9. A programmable network of transmission line conductors which is capable of supporting a plurality of circuit components and providing desired electrical connections between signal sources and signal receivers of these circuit components, comprising:

a plurality of separate first micro-strip conductors;

a plurality of separate second micro-strip conductors;

a plurality of separate third micro-strip conductors;

a conductive ground plane;

said first and third conductors being formed in different directions and aligned on distinct planes which are separated from each other by a layer of semiconductor material which is capable of providing programmable electrical connections between selected ones of said first conductors with selected ones of said third conductors;

said second conductors being insulated from said first conductors and separated from said third conductors by a layer of said semiconductor material so that programmable electrical connections can be made between said third conductors and selected ones of said second conductors;

said ground plane being separated from the nearest plane of said conductors by a layer of insulation;

at least some of said first conductors and at least some of said second conductors having pad means for enabling electrical connections to be made between at least one of said signal sources and at least one of said first conductors, and between at least one of said signal receivers and at least one of said second conductors;

the physical dimensions and arrangement of said first, second and third conductors relative to said ground plane being such that the characteristic impedance associated with said first conductors is smaller than the characteristic impedance associated with said third conductors, and the characteristic impedance associated with said third conductors is smaller than the characteristic impedance associated with said second conductors.

10. The programmable network according to claim 9, wherein said first conductors are wider and shorter than said third conductors, said third conductors are wider than said second conductors, and the plane of said first conductors being disposed further from said ground plane than the plane of said third conductors.

11. The programmable network according to claim 10, wherein said second conductors are disposed in the same plane as said first conductors.

* * * * *

UNITED STATES PATENT AND TRADEMARK OFFICE

CERTIFICATE OF CORRECTION

PATENT NO. : 5,097,232

DATED : March 17, 1992

INVENTOR(S) : Stopper

It is certified that error appears in the above-identified patent and that said Letters Patent is hereby corrected as shown below:

Column 1, line 56, delete "in" and insert --is--;

Column 2, line 51, delete "line" and insert --like--;

Column 2, line 64, delete "and" and insert --are--;

Column 4, line 20, delete " $\sqrt{LC \cdot \alpha}$ " and insert -- $\sqrt{LC}\ (1 + \alpha)$ --;

Column 4, line 34, delete "over-shorting" and insert -- over-shooting--;

Column 8, line 12, delete "pedestral" and insert -- pedestal--;

Column 9, line 51, delete "each of each" and insert --end of each--;

Column 10, line 29, delete "parameters" and insert --parameter--;

Column 12, line 4, delete "$Z_{ol}$ In One" and insert --$Z_{ol}$. In one--;

UNITED STATES PATENT AND TRADEMARK OFFICE

CERTIFICATE OF CORRECTION

PATENT NO. : 5,097,232

DATED : March 17, 1992

INVENTOR(S) : Stopper

It is certified that error appears in the above-identified patent and that said Letters Patent is hereby corrected as shown below:

Column 13, line 13, delete "bound" and insert --found--;

Column 13, line 19, delete "divided" and insert --divide--;

Column 13, line 41, delete "he" and insert --the--;

Column 14, line 64, delete "CB" and insert --SCB--;

Column 16, line 40, delete "greater" and insert --less--;

Column 11, line 45, delete "$z_{ol}$" and insert --$Z_{ol}$--.

Signed and Sealed this

Thirteenth Day of July, 1993

Michael K. Kirk

*Attest:*

MICHAEL K. KIRK

*Attesting Officer*

*Acting Commissioner of Patents and Trademarks*